United States Patent [19]

Malick

[11] 4,258,345

[45] Mar. 24, 1981

[54] CIRCUIT INTERRUPTER WITH MAGNETIC ARC STRETCHER

[75] Inventor: Franklin S. Malick, Monroeville, Pa.

[73] Assignee: Westinghouse Electric Corp., Pittsburgh, Pa.

[21] Appl. No.: 7,523

[22] Filed: Jan. 29, 1979

[51] Int. Cl.[3] ..... H01H 9/30; H01H 33/04

[52] U.S. Cl. ..... 335/201; 200/144 R; 200/147 R

[58] Field of Search ..... 335/201, 147 B, 147 R, 335/147 A, 144 R

[56] References Cited

U.S. PATENT DOCUMENTS

| | | | |
|---|---|---|---|
| 1,925,858 | 9/1933 | Baker | 200/144 |
| 2,428,254 | 9/1947 | Walle | 200/147 |
| 2,875,301 | 2/1959 | Immel | 200/147 |
| 3,243,559 | 3/1966 | Heft | 200/147 R |
| 3,641,293 | 2/1972 | Armitage et al. | 200/147 B |
| 3,956,723 | 5/1976 | Dickens et al. | 335/201 |
| 3,959,753 | 5/1976 | Wafer | 335/16 |

*Primary Examiner*—Harold Broome
*Attorney, Agent, or Firm*—Robert E. Converse, Jr.

[57] ABSTRACT

A molded case circuit breaker includes separable contacts, a conventional operating mechanism, and means for magnetically stretching the arc upon contact separation to provide current limiting action. In a first embodiment, the arc stretcher comprises three separate stacks of spaced parallel U-shaped magnetic plates each oriented to provide a slot parallel to the plane of the loop formed by an expanding arc. In a second embodiment, the U-shaped plates each comprise a plurality of coplanar interleaved magnetic plates electrically insulated therebetween and having extending members to form pins lining the sides of the slot formed by the stack of plates. Additional independent pins inserted into the slots of an arc chute are also provided. A third embodiment includes fixed and movable contact arms and conductive means attached thereto to provide current flow in opposite directions through the contact arms. The contact arms and conductive means are positioned and sized so as to provide positive arc positioning.

12 Claims, 9 Drawing Figures

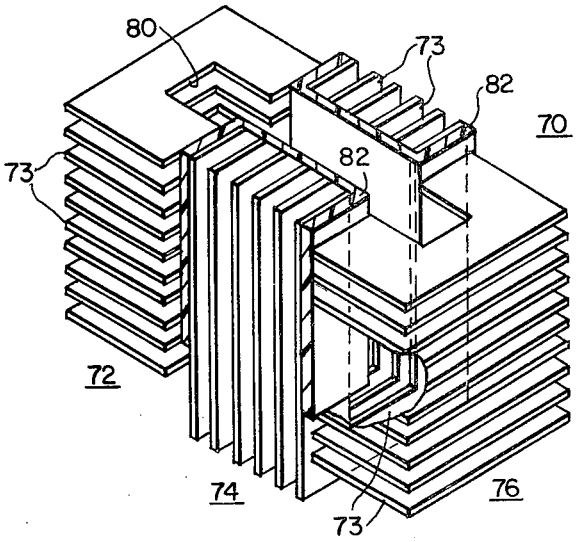
FIG. 3.
FIG. 4.
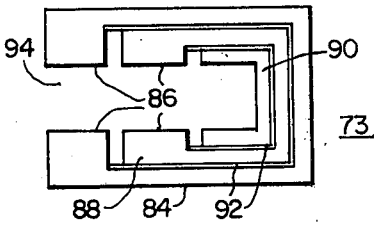
FIG. 9.
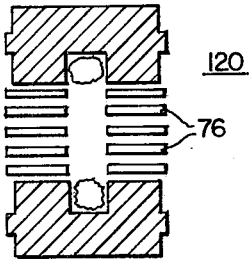
FIG. 8.
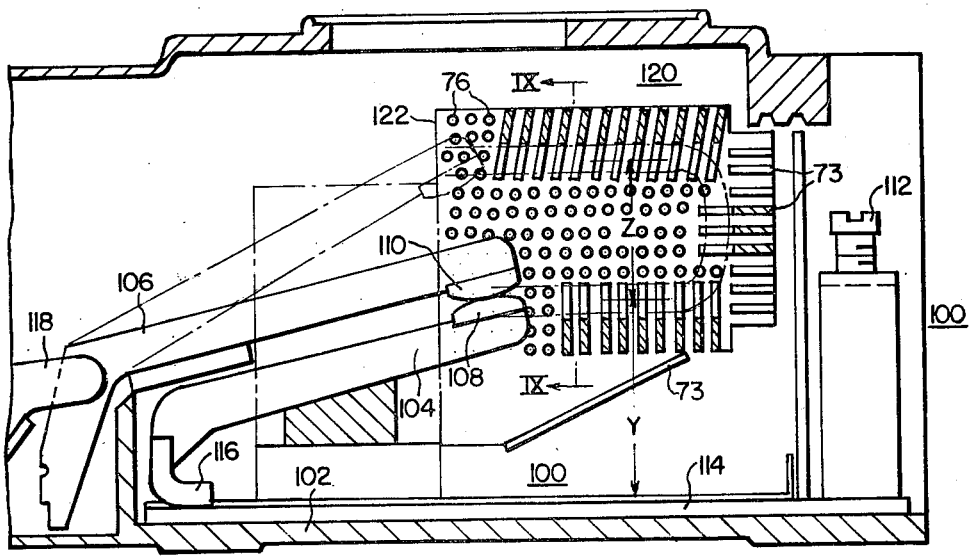

CIRCUIT INTERRUPTER WITH MAGNETIC ARC STRETCHER

BACKGROUND OF THE INVENTION

1. Field of the Invention

The invention relates generally to current limiting circuit interrupters and, more particularly, to molded case circuit interrupters having a magnetic arc stretcher.

2. Description of the Prior Art

Circuit breakers are widely used in industrial, commercial, and residential environments to protect power distribution equipment against damage from overcurrent conditions. Such circuit breakers have traditionally employed spring-loaded operating mechanisms which provide for manual opening and closing of the contacts therein, and a trip mechanism responsive to overload current conditions for releasing a latch to allow the operating mechanism spring to automatically separate the contacts.

As the capacity of supply circuits increased to accommodate the ever higher consumption of electrical energy, larger fault currents became available to flow under short circuit conditions. In order to properly protect against these higher available fault currents, current limiting devices were employed to prevent short circuit current from rising to the level of the full available fault current. Although the earliest current limiting systems employed separate units connected in series with conventional circuit breakers, there is an increasing trend to combine current limiting capabilities and standard overload circuit interrupting capabilities into a single device.

One method of obtaining current limiting in a mechanical circuit breaker is to provide means for rapidly separating the contacts a long distance upon detection of short circuit conditions, drawing an extended arc therebetween. The relatively high voltage developed across the long arc opposes the rise in short circuit current flow. Although considerable success has been achieved through this method, the size limitations of smaller rating circuit breakers, especially molded case circuit breakers, has restricted the available contact separation distance and, therefore, the arc voltage which can be developed.

Another means of obtaining a high arc voltage to produce effective current limiting action is to magnetically stretch the arc to provide an arc path longer than the contact separation distance. An example of a circuit interrupter employing magnetic means to stretch the arc is described in U.S. Pat. No. 2,734,970, issued Feb. 14, 1956 to Neilus A. Spears, Jr. and assigned to the assignee of the present invention. The circuit breaker described therein is a high power direct current circuit breaker operating at a potential of 1,000 volts. It would be desirable to provide a circuit interrupter employing a magnetic arc stretcher which is suitable for use in applications requiring a molded case circuit breaker.

SUMMARY OF THE INVENTION

In accordance with the principles of the present invention there is provided a molded case circuit breaker having separable contacts and an operating mechanism disposed in a molded insulating housing. A magnetic arc stretcher device is provided to magnetically drive an arc formed by separation of the contacts upon overcurrent conditions into an extended path much longer than the straight line separation distance between the contacts. In one embodiment of the invention, the arc stretcher device comprises three separate lamination stacks, each stack including a plurality of U-shaped flat magnetic plates stacked together to form a slotted magnetic device. Two of the stacks are positioned with the open ends of the slots facing each other on opposite sides of a plane between the contacts. The third stack is positioned between the first two with the open end of the slot facing the contacts. The entire magnetic arc stretcher is positioned in the circuit breaker housing such that the separable contacts are located between the first two lamination stacks and in proximity to the open end of the third lamination stack. The sides of the slots of each of the lamination stacks are insulated, with the exception of the area near the bottom of the slots. Upon separation of the contacts due to an extreme overload condition, an arc is drawn between the contacts to produce magnetic flux in the area between the legs of each of the lamination stacks. This magnetic flux rapidly drives the arc toward the bottom of the slot in each of the lamination stacks, thereby rapidly stretching the arc to provide a high arc voltage and current limiting action.

A second embodiment is similar to the first, with the exception that each of the magnetic plates is formed from a plurality of components rather than a single unitary U-shaped plate. Each plate comprises a plurality of concentric coplanar substantially U-shaped components positioned with electrical insulation therebetween to form a substantially U-shaped composite plate. Since the components of each plate are insulated from each other, the slot formed in the lamination stack of the second embodiment requires no insulation upon which the arc will impinge. In other respects, the magnetic arc stretching device of the second embodiment is similar to the first.

A third embodiment provides a circuit breaker having a magnetic arc stretching device comprising a plurality of lamination stacks, each stack including either unitary plates or composite plates as described with regard to the second embodiment. In addition, the third embodiment includes a plurality of separate steel pins lining the walls of the magnetic arc stretcher device to precisely locate the position of the arc loop and to provide for cooling and deenergization of the established arc. Also, the moving contact is mounted upon a contact arm which is connected in the circuit breaker so as to provide current flow opposite in direction to the current through the lead to the fixed contact. The two current loops formed in the circuit interrupter have dimensions such as to provide for positive stable arc positioning within the magnetic arc stretcher device.

BRIEF DESCRIPTION OF THE DRAWINGS

FIG. 3 is a perspective view of the circuit breaker arc stretcher device shown in FIGS. 1 and 2;

FIG. 4 is an elevational view of a composite magnetic plate employed in a second embodiment of the invention;

FIG. 8 is a partial side sectional view of a third embodiment of the present invention; and FIG. 9 is a partial end sectional view of the circuit breaker shown in FIG. 8, taken along the line IX—IX of FIG. 8;

DESCRIPTION OF THE PREFERRED EMBODIMENT

Figure 1:
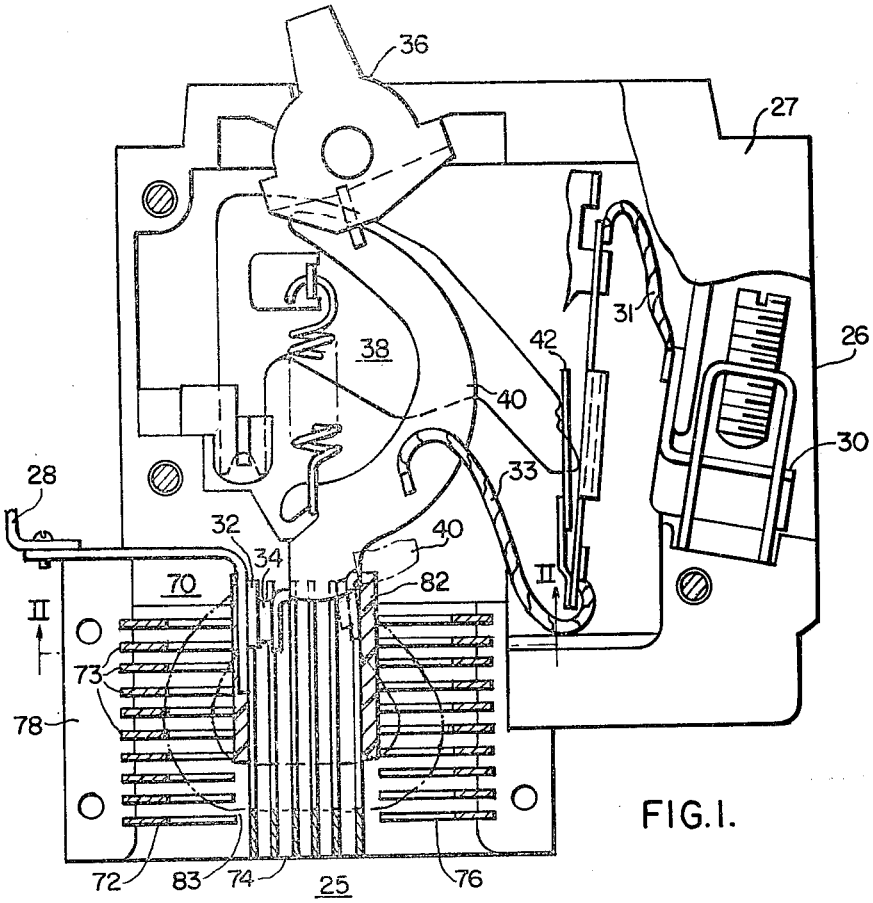
FIG. 1 is a side sectional view of a molded case circuit breaker employing the principles of the present invention.

Referring now to the drawings, in which corresponding reference characters refer to corresponding components, FIG. 1 shows a molded case circuit breaker 25 employing the principles of the present invention. The circuit breaker 25 includes a molded insulating housing 26 into which are seated terminals 28 and 30 adapted for connection to an electrical circuit to be protected. An insulating cover 27, shown partially cut away, cooperates with the housing 26 to enclose the breaker 25. Electrically connected to the terminal 28 is a fixed contact 32 which cooperates with a movable contact 34 mounted upon a contact arm 40. The terminal 30 is connected by a woven shunt 31 to one end of a trip assembly 42, the other end of which is connected by a woven shunt 33 to the contact arm 40. The current path through the circuit breaker 25 thus extends from the terminal 30 through the shunt 31, the trip assembly 42, the shunt 33, and the contact arm 40 to the movable contact 34, the fixed contact 32, and the terminal 28.

Manual operation of a handle 36 actuates an operating mechanism shown generally at 38 which causes the contact arm 40 to move in a well-known manner, thereby separating the contacts 32 and 34 and interrupting the electrical circuit connected externally to the terminals 28 and 30. The trip assembly 42 operates in a well-known manner to automatically initiate separation of the contacts 32 and 34 upon overcurrent conditions through the circuit breaker 25.

The operating mechanism 38 is similar to the operating mechanism of the circuit breaker described in U.S. Pat. No. 3,110,786, issued Nov. 12, 1963, to Francis L. Gelzheizer and assigned to the assignee of the invention. Thus, the operation of the mechanism 38 will not be described in detail. Manual operation of the handle 36 is operable to cause the contact arm 40 to pivot and move the movable contact 34 between open and closed positions. In addition, low to moderate overload currents through the circuit breaker 25 will cause the trip assembly 42 to operate in a manner more completely described in the aforementioned U.S. Pat. No. 3,110,786 to automatically cause the operating mechanism 38 to move the movable contact 34 to the open position.

Figure 2:
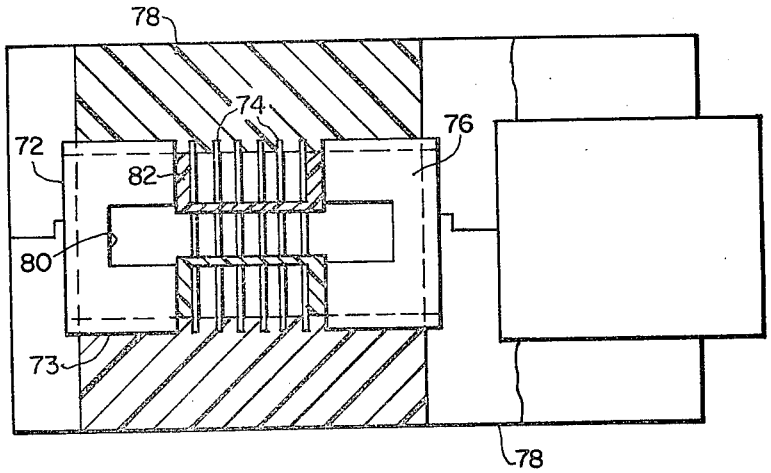
FIG. 2 is a top sectional view taken along the line II—II of FIG. 1.

The circuit interrupter 25 also includes a magnetic arc stretcher device 70 comprising three separate lamination stacks 72, 74, 76. Each of the lamination stacks comprise a plurality of substantially U-shaped plates 73 as can be seen most clearly in FIGS. 2 and 3. Each plate can be positioned in grooves in an arc stretcher housing 78 with insulating air therebetween. Alternatively, each lamination stack could be fabricating using solid insulating material such as fiber board to form a unitary component. Each lamination stack could then be positioned within the housing 78.

It can be seen in FIG. 3 that the three lamination stacks 72, 74, 76 are positioned so as to provide a three dimensional magnetic arc stretcher having a slot 80. Ceramic insulation 82 is provided on the inner walls of the slot 80 to prevent arc current from running down the legs of the plate stack 74. Note that the bottom of the slot 80 in each of the lamination stacks 72, 74, 76 is uninsulated to allow the stretched arc to impinge directly on the steel plates.

A short arc is drawn as the contacts separate. Since this arc is in the magnetic field of the slot 80, an electrodynamic force is developed on the arc which is perpendicular to the current direction at each point of the arc. The midsection of the arc will thus have a force developed on it by the lamination stack 74, causing the arc to bow out toward the bottom of the slot 80 into the bases of the lamination stacks 72, 74, 76 to a position 83 as shown in FIG. 1.

Since the arc has essentially zero mass, it will move very rapidly to its final position 83 at the bottom of the slots in all three of the lamination stacks. The arc will thus be stretched to its maximum length and therefore to its maximum voltage while the contact arm has traveled only a short distance. Since the arc is drawn magnetically into the bottom of the slots of all the lamination stacks, it has a length which is much longer than the direct path from the movable contact 34 to the fixed contact 32. The arc is held magnetically at the bottom of the slot in contact with the steel plates, vaporizing a portion thereof to absorb energy from the arc. Gases produced by the arc are free to flow between the plates 73 of the stack 74 and out of the housing 26.

If it is desired to provide a circuit breaker having a magnetic arc stretcher which does not require insulated slot side walls, one or more lamination stacks may be composed of magnetic plates 73' as shown in FIG. 4. As can be seen therein, each plate 73' is composed of a plurality of coplanar concentric interleaved components. The outer component 84 is substantially U-shaped and includes two inwardly projecting members 86. A smaller U-shaped component 88 is positioned within the confines of the outer component 84 and also includes inwardly projecting members 86. The components 84 and 88 (having the projections 86) may also be described as C-shaped. Additional U-shaped members may also be provided each having the projecting member 86 or, as shown in FIG. 4, a total of three members may be provided with the innermost U-shaped member 90 being without the projections 86.

Each of the components 84, 88 and 90 of the plate 73' is insulated from the others by thin insulation 92 and by a larger air gap between adjacent members 86. As can be seen, the members 86 and the inner surface of the member 90 define the walls of a slot 94. However, since the components are insulated one from the other, the arc is not shorted out along the legs of the plate 73' as would be the case with uninsulated magnetic arc stretchers composed of unitary plates 73. The plates 73' can have 2, 3, or any number of components 84, 88 and 90. The important feature is that these components are insulated from each other to prevent the high voltage stretched arc from shorting out along the legs of the plates.

Although the current is prevented from short-circuiting through the length of the legs of the plates 73' by the insulating members between the components, the magnetic structure is very similar to the standard U-shaped plate 73. Thus, only a small reduction in magnetic field strength is provided by the multicomponent construction. The plate 73' still provides an all-iron return path for the majority of flux which crosses the slot from leg to leg of the plate 73'.

Figure 5:
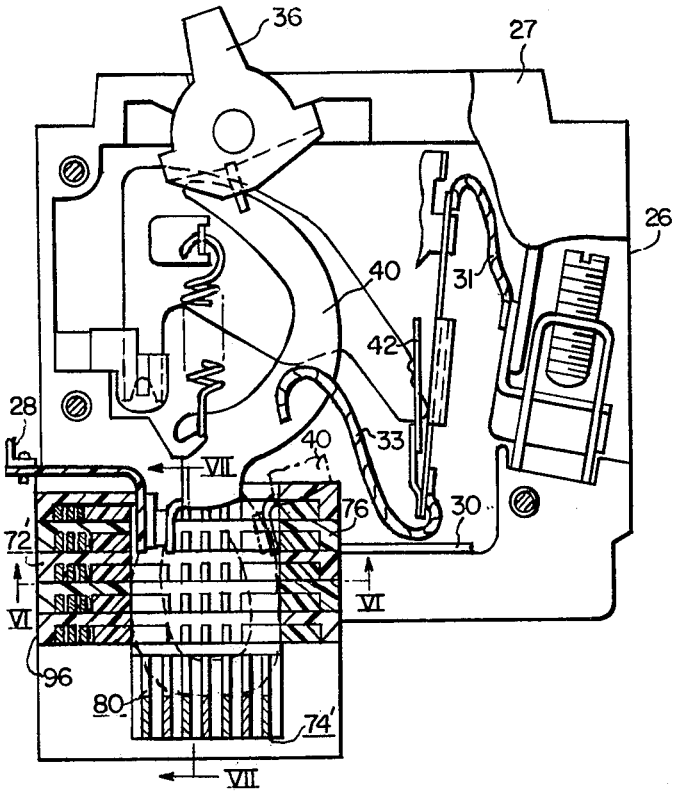
FIG. 5 is a side sectional view of a molded case circuit breaker employing a second embodiment of the present invention.

A circuit breaker having a magnetic arc stretching device composed of plates 73' is shown in FIG. 5. There the lamination stack 72' is composed of such multicomponent plates 73'. The lamination stacks 74 and 76 may be composed of standard unitary U-shaped plates 73 as shown in FIG. 5 or may be made up of the multicomponent plates 73'.

Figure 6:
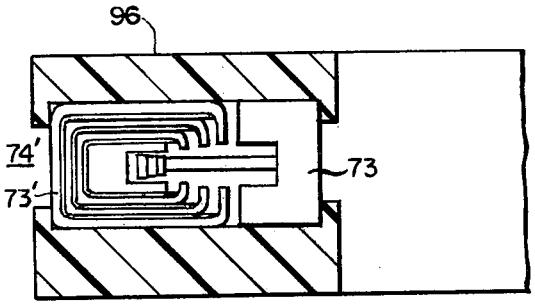
FIG. 6 is a top sectional view of the circuit breaker shown in FIG. 5, taken along the line VI—VI.

As can be seen in FIG. 6, the plates 73' are made of rectangular steel bar stock $\frac{1}{8}''$ by 1/16". These bars are bent into C-shape and dropped into grooves in supporting insulating plates 96. The plates 96 are then stacked like pancakes with the planes of the plates 96 being perpendicular to the plane of the stretched arc loop.

As can be seen in FIG. 5, the contacts 32 and 34 are located well down into the steel slot 80 so that the initial arc which forms when the contacts separate will be subject to the strong magnetic field which is developed in the slot. The arc will be subject to a force along its entire length which is always perpendicular to the direction of current flow. The relatively short arc between the contacts will thus be forced to stretch as a loop which increases in diameter until it settles into the bottom of the slot 80.

The number of plates 73' can be increased to cause an elongated arc loop of even higher arc voltage. The limit of this increase is reached when an arc will restrike across the short distance between the contacts. The voltage at which restrike will occur can be quite high, because the arc moves out of the gap between the contacts 32 and 34 very quickly, and the gap space is rapidly deionized by the close proximity of the cold steel projections 86 which form the side walls of the slot 80.

The heated air inside the loop expands and helps to propel the arc loop out into the bottom of the slot 80 around the periphery of the arc stretcher device. The gases move downward in the slot 80 of FIG. 5 and pass out between the plates 73 which form the bottom of the slot 80. These plates act as a sieve to keep the arc inside the arc stretcher device, and yet allow the expanding but deionized gases to escape from the breaker housing through the vent 98 (FIG. 7).

Figure 7:
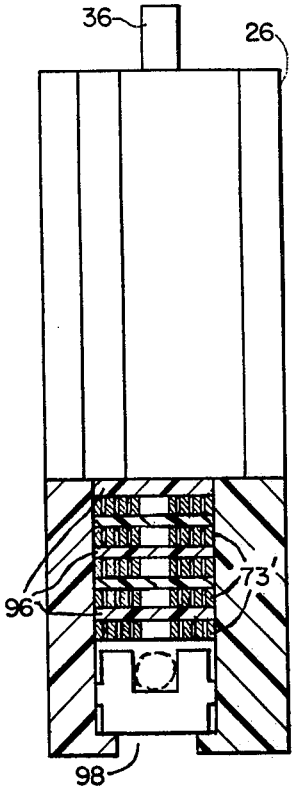
FIG. 7 is an end sectional view of the circuit breaker shown in FIGS. 5 and 6, taken along the line VII—VII of FIG. 5.

The circuit breaker of FIGS. 5, 6 and 7 show the return path for the magnetic flux in the center of the arc loop to be located completely to the left side of the contacts. This is an economical design and is satisfactory where the voltage of the stretched arc is not extremely high. When the voltage of the stretched arc must be high, the contact opening must be increased to prevent restrike. An arc stretcher device could accordingly be designed to provide a return path for the arc loop flux both to the left and to the right of the contacts.

A circuit breaker having an arc stretcher device with the construction shown in FIGS. 1 and 5 can produce arc stretching action at current levels as low as 200 amperes. In order to obtain a circuit breaker of higher rating, a construction as shown in FIG. 8 can be provided. FIG. 8 shows a side sectional view of a portion of a circuit interrupter 100 having an insulating housing 102 and a pair of contact arms 104 and 106. These contact arms carry contacts 108 and 110 respectively. The lower arm 104 is fixed and is connected to a load terminal 112 through conductors 114 and 116. The upper arm 106 is connected by any suitable means (not shown) to a line terminal at the other end of the breaker. The arm 106 is pivoted to a movable carriage 118 which is connected to an operating mechanism in a well-known manner such as is shown in U.S. Pat. No. 3,575,679. An arc stretcher device 120 comprises a plurality of U-shaped plates 73 (as shown in FIG. 1) formed into a lamination stack which may be set at an angle. Additional unitary U-shaped lamination plates 73 are provided at the right and bottom of the arc stretcher device 120. In addition, a plurality of free-standing steel pins 76 are inserted through support walls 122 of insulating material.

Since the pins 76 do not provide an iron return path for the flux produced around the arc loop, the force developed on the arc by a magnetic flux will not be as great. Thus, arc driving will not occur until higher current levels than in the previously described embodiments. However, the pins 76 act to cool and deionize the gases produced by the arc to prevent a new low voltage arc from forming between the contacts and shorting out the desired high voltage stretched arc. At high current levels, the iron in the plate 73 saturates and thus does not contribute significantly to the force upon the arc.

It can be seen that current flow through the stretched arc results in a current loop producing magnetic flux to maintain the arc in the bottom of the slot of the arc stretcher device 120. However, the conductors 114, 116, the contact arm 104, and the bottom leg of the arc form a second current loop. Flux produced by this second current loop would tend to drive the arc out of the bottom of the slot in plates 73. Therefore, it is important that the distance Y between the sides of the loop defined by the contact arm 104 and conductor 114 be greater than distance Z between the sides of the loop formed by the arc itself. In this manner it can be assured that the arc will settle in the bottom of the slot.

The pins 76 can be of material other than steel, for example, ceramic. In any case, the pins absorb arc energy as the arc stretches, and thus influence the arc to develop a high arc voltage. Most important, however, is the fact that the turbulent hot gases left behind after passage of the leading edge of the arc loop penetrate the sides of the slot between the pins to be cooled. Also, ionizing radiation from the arc is absorbed in the space between the pins which acts somewhat as a black body hole. The pins thus perform the same functions as Deion plates in standard circuit breakers, but they do so without providing a conducting path which will short out a length of the arc column. The pins also keep the hot arc from contacting the insulation which supports the pins 76 and plate 73 and therefore prevents the generation of gases which can cause a new arc to strike between the contacts. The pins and plates can thus be supported with low cost insulating materials instead of ceramics.

As can be seen in FIG. 8, the breaker 100 also includes a magnetic contact drive device more completely described in copending U.S. patent application Ser. No. 951,941, filed Oct. 16, 1978, by John A. Wafer et al. Although the contact arm 106 is driven to an open position by electrodynamic action produced by the magnetic drive device 106, the arc, which is essentially massless, will begin to stretch by the time the contacts are separated by a small distance. The arc will attain its full loop length by the time the contact arm 106 has reached its full travel. It should be noted that the fixed contact 108 is not located at the bottom of the housing 102 but is raised so that the current loop formed by the conductor 114 and arm 104 is wider (dimension Y of FIG. 8) than the width of the current loop formed by the arc (dimension Z).

In summary, it can be seen that the present invention provides a molded case circuit breaker employing a magnetic arc stretcher having the capability to provide current limiting action by rapidly expanding an established arc at lower fault current levels than heretofore possible. In addition, an alternative embodiment of the present invention provides for stable, positive arc positioning in a circuit interrupter having a higher current rating.

We claim:

1. A circuit breaker, comprising:

a housing;

separable contacts disposed in said housing;

an operating mechanism operable to move said contacts between open and closed positions;

an arc stretcher device comprising a first portion having a first plurality of substantially parallel U-shaped plates of magnetic material each having two legs and a bight portion connected therebetween, a second portion having a second plurality of substantially parallel U-shaped plates each having two legs and a bight portion connected therebetween, the plates of said second portion pointing in an opposite direction from the legs of said first portion and being substantially parallel thereto, and a third portion having a third plurality of substantially parallel U-shaped plates each having two legs and a bight portion connected therebetween, the plates of said third portion extending in a direction substantially perpendicular to the plates of said first and second portions; and insulating means disposed in said arc stretcher device for preventing arc current from flowing through said plates;

said contacts being disposed between the legs of said arc stretcher device opposite said third portion so that an arc established by opening of said contacts initially extends in a direction generally parallel to the plates of said first and second portions and is rapidly driven by magnetic action into the area between the legs of said plates to stretch said arc, develop a high arc voltage, and provide current limiting action.

2. A circuit interrupter as recited in claim 1 wherein said insulating means is disposed on the inner surface of the legs of said U-shaped plates for insulating said plates from an arc established by separation of said contacts.

3. A circuit interrupter as recited in claim 1 wherein said insulating means is disposed about only a portion of said U-shaped magnetic plates.

4. A circuit interrupter as recited in claim 3 wherein said insulating means is disposed so as to allow an established arc to impinge directly upon the bight portions of said plates.

5. A circuit interrupter as recited in claim 4 wherein the portion of said U-shaped magnetic plates in immediate proximity to said separable contacts remains uninsulated.

6. A circuit interrupter as recited in claim 1 wherein said arc stretcher third portion extends between said first and second portions.

7. A circuit interrupter, comprising:

a housing;

separable contacts disposed in said housing;

an operating mechanism operable to move said contacts between open and closed positions; and a slotted arc stretcher device comprising a plurality of U-shaped arc driving plates, said plates comprising a first substantially U-shaped plate member of magnetic material, a second substantially U-shaped plate member of magnetic material smaller than said first plate member disposed within the confines of said first plate member and lying in the same plane thereof, and means for electrically insulating said first plate member from said second plate member.

8. A circuit interrupter as recited in claim 7 wherein each of said first and second plate members comprises portions inwardly extending at right angles thereto, and said insulating means comprises a substantially U-shaped insulating member lying in the same plane as said first and second plate members and positioned therebetween.

9. A circuit interrupter as recited in claim 8 wherein each of said plates comprises a plurality of concentric substantially U-shaped plate members electrically insulated one from the other, each of said U-shaped plate members having a connecting portion and a pair of legs each having a portion inwardly extending from said legs at right angles thereto, said plates also having an innermost U-shaped plate member;

the ends of said extending portions and the inner edges of the legs of said innermost U-shaped member defining an arc-receiving slot.

10. A circuit interrupter, comprising:

a housing;

separable contacts disposed in said housing and being operable between open and closed positions;

terminal means for connecting said circuit interrupter to an external electrical circuit being protected;

conductive means for supporting said contacts;

means for connecting said terminal means and said contact support means; and an arc stretcher device for stretching and positioning an arc established by said separable contacts, said arc being rapidly positioned into an arc loop having two substantially parallel arc sides connected by a middle arc portion;

said connecting means and said contact support means forming a conductive loop having two substantially parallel conductor side members, the distance between said conductor side members being greater than the distance between said arc loop sides.

11. A circuit interrupter as recited in claim 10 wherein said arc stretcher device comprises a plurality of U-shaped plates having two legs and a bight portion connected therebetween and a plurality of pins of magnetic material extending perpendicular to said legs, the ends of said pins and the inner edges of said legs being arranged to define an arc receiving slot having a plane parallel to the plane of said arc loop, the inner edges of said bight portions defining the bottom of said slot.

12. A current limiting circuit interrupter, comprising:

a housing;

separable contacts disposed in said housing;

an operating mechanism for moving said contacts between open and closed positions; and a slotted magnetic arc stretcher comprising a pair of side walls defining a slot substantially parallel to the path of movement of said contacts and a plurality of spaced U-shaped plates defining an arc-receiving channel at the bottom of said slot, said side walls comprising a plurality of pins projecting at substantially right angles to said side walls and to an arc established between said contacts following an opening operation, said pins being positioned between said contacts and said plates, whereby said pins absorb energy from an established arc.

* * * * *